US011605517B2

(12) United States Patent
Mantoan

(10) Patent No.: US 11,605,517 B2
(45) Date of Patent: Mar. 14, 2023

(54) RELAY INCLUDING BISTABLE DISCONNECT SWITCH

(71) Applicant: Littelfuse, Inc., Chicago, IL (US)

(72) Inventor: Davide Mantoan, Legnago (IT)

(73) Assignee: Littelfuse, Inc., Chicago, IL (US)

( * ) Notice: Subject to any disclaimer, the term of this patent is extended or adjusted under 35 U.S.C. 154(b) by 307 days.

(21) Appl. No.: 17/070,201

(22) Filed: Oct. 14, 2020

(65) Prior Publication Data

US 2022/0115199 A1 Apr. 14, 2022

(51) Int. Cl.

| | |
|---|---|
| ***H01H 47/22*** | (2006.01) |
| ***H01H 49/00*** | (2006.01) |
| ***H01H 50/02*** | (2006.01) |
| ***H01H 50/44*** | (2006.01) |
| ***H01H 50/56*** | (2006.01) |

(52) U.S. Cl.

CPC ..... *H01H 47/226* (2013.01); *H01H 49/00* (2013.01); *H01H 50/02* (2013.01); *H01H 50/44* (2013.01); *H01H 50/56* (2013.01)

(58) Field of Classification Search

CPC ..... H01H 47/226; H01H 50/02; H01H 50/44; H01H 50/56; H01H 49/00

See application file for complete search history.

(56) References Cited

U.S. PATENT DOCUMENTS

| | | | | |
|---|---|---|---|---|
| 3,248,499 | A | 4/1966 | Young | |
| 6,199,587 | B1 * | 3/2001 | Shlomi | F16K 31/082 137/625.5 |
| 2002/0135447 | A1 | 9/2002 | Gruner | |
| 2004/0025949 | A1 | 2/2004 | Wygnaski | |
| 2018/0166244 | A1 * | 6/2018 | Kobayashi | H01H 50/54 |

FOREIGN PATENT DOCUMENTS

| | | | |
|---|---|---|---|
| DE | 4415068 | A1 | 11/1995 |

* cited by examiner

*Primary Examiner* — Harry R Behm
(74) *Attorney, Agent, or Firm* — KDB Firm PLLC

(57) ABSTRACT

Provided herein are methods for an improved bi-stable relay. In some embodiments, a method may include providing a core assembly within a housing, the core assembly comprising a plunger extending through a coil support structure. The method may further include winding a first coil and a second coil about a central section of the coil support structure, providing a first magnet and a first ferromagnetic plate at a first end of the coil support structure, and providing a second magnet and a second ferromagnetic plate at a second end of the coil support structure. In some embodiments, the method may further include activating the first coil or the second coil to move the plunger between a first position and a second position, wherein in the first position a circuit formed by a set of contacts is closed, and wherein in the second position the circuit is open.

19 Claims, 6 Drawing Sheets

RELAY INCLUDING BISTABLE DISCONNECT SWITCH

FIELD OF THE DISCLOSURE

The disclosure relates generally to the field of circuit protection devices and, more particularly, to relays including a bistable disconnect switch.

BACKGROUND OF THE DISCLOSURE

Electrical relays are devices that enable a connection to be made between two electrodes in order to transmit a current. Some relays include a coil and a magnetic switch. When current flows through the coil, a magnetic field is created proportional to the current flow. At a predetermined point, the magnetic field is sufficiently strong to pull the switch's movable contact from its rest, or de-energized position, to its actuated, or energized position pressed against the switch's stationary contact. When the electrical power applied to the coil drops, the strength of the magnetic field drops, releasing the movable contact and allowing it to return to its original de-energized position. A normally open relay, for example, is a switch that keeps its contacts closed while being supplied with the electric power and that opens its contacts when the power supply is cut off.

One conventional relay employs a single magnet and a single coil, with current flowing in one sense or the opposite, plus a spring for biasing purposes. Another conventional relay includes a single coil with mechanical retention by a cam. No magnet is present. Therefore, what is needed is an improved mechanism to achieve bi-stability in the relay.

SUMMARY OF THE DISCLOSURE

The Summary is provided to introduce a selection of concepts in a simplified form, the concepts further described below in the Detailed Description. The Summary is not intended to identify key features or essential features of the claimed subject matter, nor is the Summary intended as an aid in determining the scope of the claimed subject matter.

In one approach according to the present disclosure, a method may include providing a core assembly within a housing, the core assembly comprising a plunger extending through a coil support structure, and winding a first coil and a second coil about a central section of the coil support structure. The method may further include providing a first magnet at a first end of the coil support structure, providing a second magnet at a second end of the coil support structure, and coupling a first electromagnetic shell component and a second electromagnetic shell component to the coil support structure, wherein the first and second electromagnetic shell components are maintained in position by the first and second magnets.

In another approach according to the present disclosure, a method may include providing a core assembly including a plunger extending through a coil support structure, and winding a first coil and a second coil about a central section of the coil support structure. The method may further include providing a first magnet and a first ferromagnetic plate at a first end of the coil support structure, providing a second magnet and a second ferromagnetic plate at a second end of the coil support structure, and activating the first coil or the second coil to move the plunger between a first position and a second position, wherein in the first position a circuit formed by a set of contacts is closed, and wherein in the second position the circuit is open.

BRIEF DESCRIPTION OF THE DRAWINGS

The accompanying drawings illustrate exemplary approaches of the disclosed embodiments so far devised for the practical application of the principles thereof, and in which.

Figure 1:
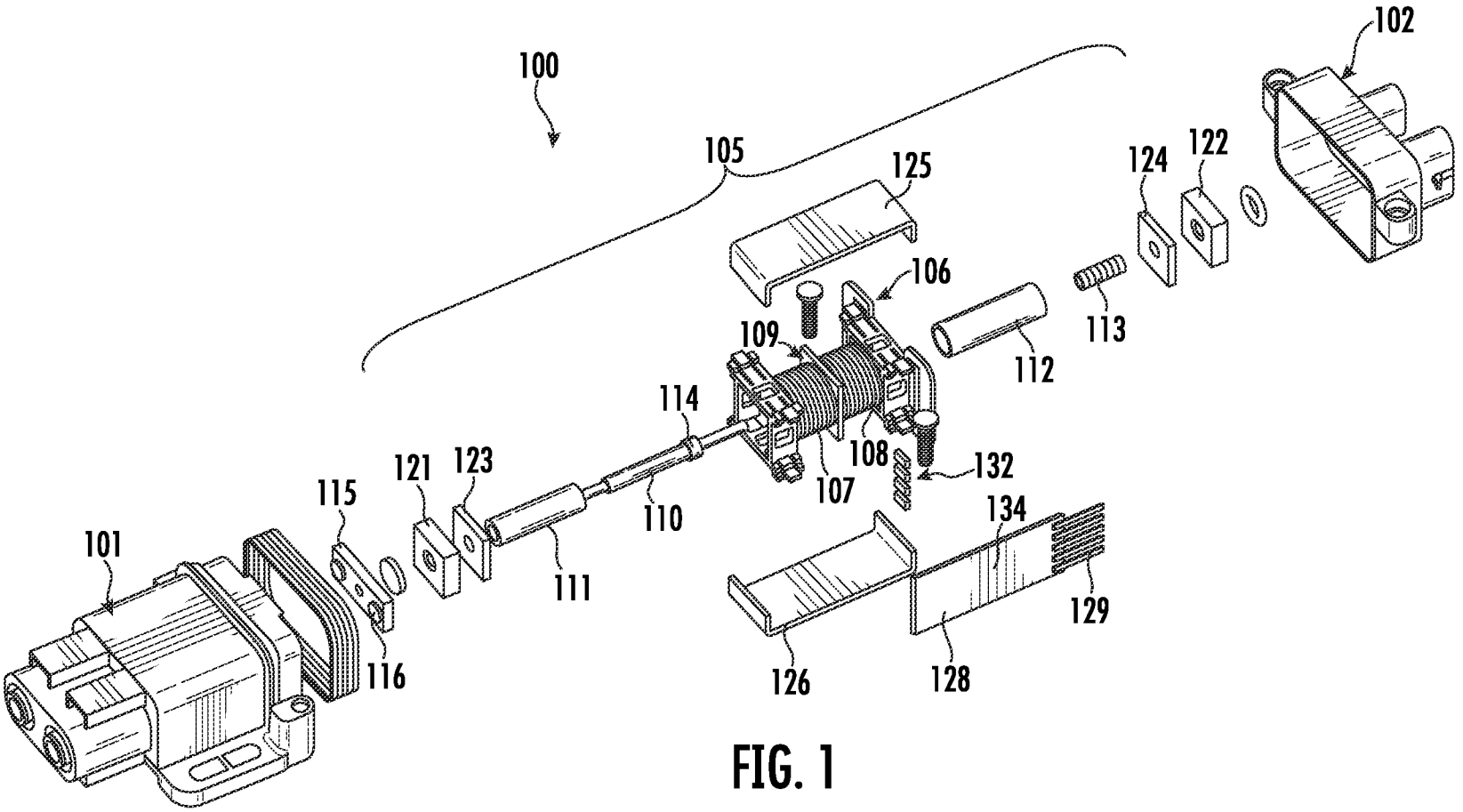
FIG. 1 depicts an exploded perspective view of an assembly according to embodiments of the present disclosure.

The drawings are not necessarily to scale. The drawings are merely representations, not intended to portray specific parameters of the disclosure. The drawings are intended to depict typical embodiments of the disclosure, and therefore should not be considered as limiting in scope. In the drawings, like numbering represents like elements.

Furthermore, certain elements in some of the figures may be omitted, or illustrated not-to-scale, for illustrative clarity. Furthermore, for clarity, some reference numbers may be omitted in certain drawings.

DETAILED DESCRIPTION

Assemblies, devices, and methods in accordance with the present disclosure will now be described more fully hereinafter with reference to the accompanying drawings. The Assemblies, devices, and methods may be embodied in many different forms and should not be construed as being limited to the embodiments set forth herein. Rather, these embodiments are provided so that this disclosure will be thorough and complete, and will fully convey the scope of the system and method to those skilled in the art.

As will be described herein, embodiments of the present disclosure are directed to relays including a multi-part core shell held together by a magnetic force from one or more permanent magnets of the core. Advantageously, fewer fastening components (e.g., screws, rivets or the like) are required, thus saving time during assembly. Furthermore, relays of the present disclosure include two coils, wound around a coil support structure, each one close to one of the two fixed magnets. The core shell, which may include made two or more parts made from ferromagnetic material, provide a path through which a magnetic field can flow. In some embodiments, each of the fixed cores may correspond to a stable position (e.g., ON/OFF) of the switch. During operation, the coils and magnets attract a mobile core (e.g., plunger and contact plate), retaining the mobile core in a stable position. The coils, when activated, change the whole magnetic field, e.g., by increasing or decreasing the magnetic field in one side of the magnet, in this way letting the mobile core move by attraction to the higher magnetic field.

FIG. 1 illustrates an exploded view of a bi-stable relay assembly (hereinafter "assembly") 100 according to embodiments of the present disclosure. As shown, the assembly may include a housing made up of a first housing part 101 coupleable with a second housing part 102. The assembly 100 may further include a core assembly 105, including a coil support structure (hereinafter "support structure") 106, and a first coil 107 and a second coil 108 wound about a central section 109 of the support structure 106. Extending through the support structure 106 is a plunger 110, a first core shaft 111, and a second core shaft 112. When assembled, a spring 113 may be positioned within the first core shaft 111, e.g., against a flange 114 of the plunger 110, to bias a contact plate 115. As shown, the contact plate 115 may include one or more contacts 116.

At one end, the core assembly 105 may include a first magnet 121 and a first ferromagnetic plate 123 couplable with the support structure 106. At another end, the core assembly 105 may include a second magnet 122 and a second ferromagnetic plate 124 couplable with the support structure 106. Although shown as being cuboid-shaped, it will be appreciated that the first magnet 121, the second magnet 122, the first ferromagnetic plate 123 and the second ferromagnetic plate 124 may take on different shapes in alternative embodiments.

The core assembly 105 may further include a shell comprising a first electromagnetic shell component (hereinafter "first shell component") 125 and a second electromagnetic shell component (hereinafter "second shell component") 126 coupled to the support structure 106. In some embodiments, the first and second shell components 125, 126 are each made from a ferromagnetic material. As will be described in greater detail herein, the first and second shell components 125, 126 may be held in position by magnetic forces from the first and second magnets 121, 122.

The contact plate 115, the first and second coils 107, 108, the contacts 116, and the plunger 110 may be formed of any suitable, electrically conductive material. In some embodiments, the first and second coils 107, 108 may be copper or tin, and/or may be formed as a wire, a ribbon, a metal link, a spiral wound wire, a film, or an electrically conductive core deposited on a substrate. The conductive materials may be decided based on fusing characteristic and durability. In one embodiment, the plunger 110 and the electric contacts 116 are stainless steel.

The core assembly 105 may further include one or more printed circuit boards (PCBs) 128 and associated pins 129. In some embodiments, the PCB 128 may be coupled to the support structure 106 by one or more conductive connectors 132, which connect the PCB 128 with the first and second coils 107, 108 when, for example, electrical current is flowing. As shown, the connectors 132 may extend through corresponding openings 134 of the PCB 128.

Figure 2:
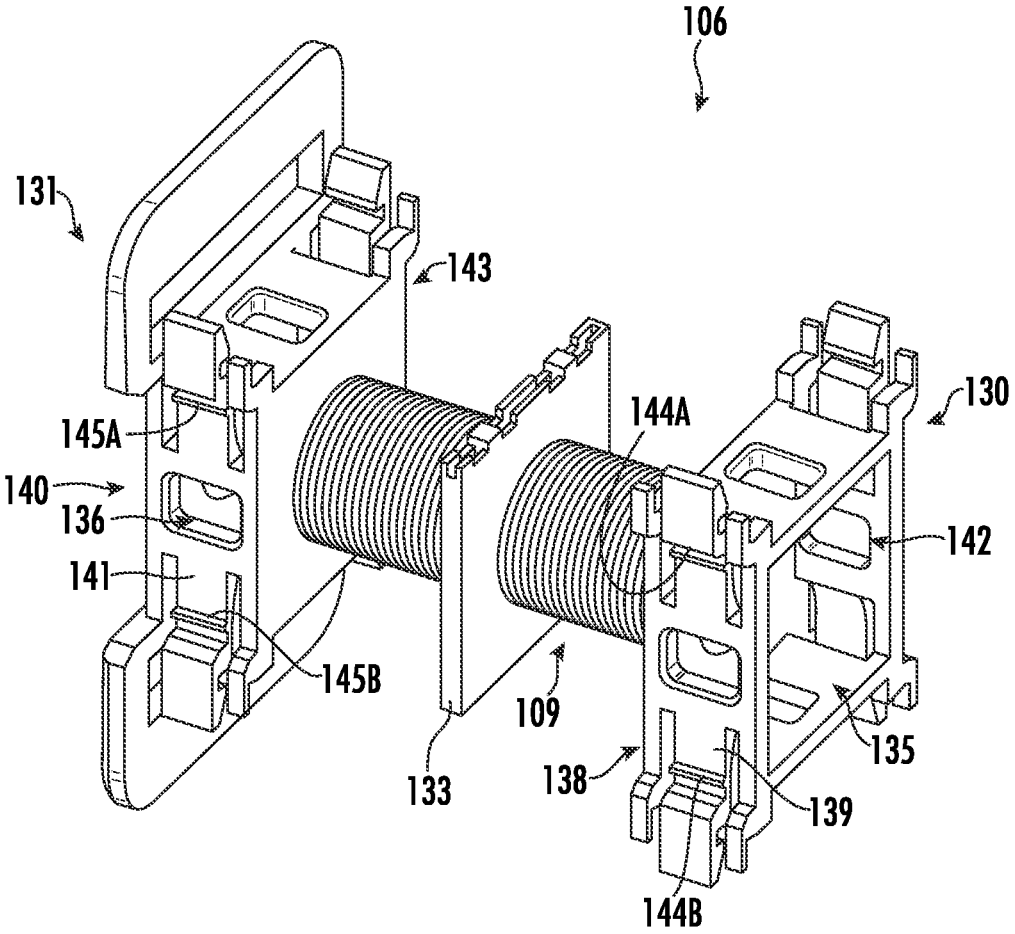
FIG. 2 depicts a perspective view of a support structure of the assembly of FIG. 1 according to embodiments of the present disclosure.

Turning now to FIG. 2, the support structure 106 according to embodiments of the present disclosure will be described in greater detail. As shown, the support structure 106 may include a first end section 130 and a second end section 131 connected at opposite ends of the central section 109. The central section 109 may be a cylinder sectioned into two halves by a separator plate 133. The separator plate 133 may be positioned between the first and second coils 107, 108 (FIG. 1). In other embodiments, the central section 109 may take on a different shape/profile.

In some embodiments, the first magnet 121 and the first ferromagnetic plate 123 may be positioned within a first interior cavity 135 defined by the first end section 130. Similarly, the second magnet 122 and the second ferromagnetic plate 124 may be positioned within a second interior cavity 136 defined by the second end section 131. In some embodiments, the first ferromagnetic plate 123 is positioned between the first magnet 121 and the first coil 107, and the second ferromagnetic plate 124 is positioned between the second magnet 122 and the second coil 108.

The first end section 130 may include a first end first recess 138 defined in part by a first recess surface 139. Similarly, the second end section 131 may include a second end first recess 140 defined in part by a second recess surface 141. Once assembled, the first shell component 125 may be positioned within the first end first recess 138 and within the second end first recess 140. On an opposite side, the first end section 130 may include a first end second recess 142, and the second end section 131 may include a second end second recess 143. The second shell component 126 may be positioned within the first end second recess 142 and within the second end second recess 143. First and second ridges 144A, 144B of the first end section 130, and first and second ridges 145A, 145B of the second section 131, help align the first shell component 125. Although not shown, ridges or other alignment features may similarly be provided along the first end second recess 142 and the second end second recess 143.

Figure 3:
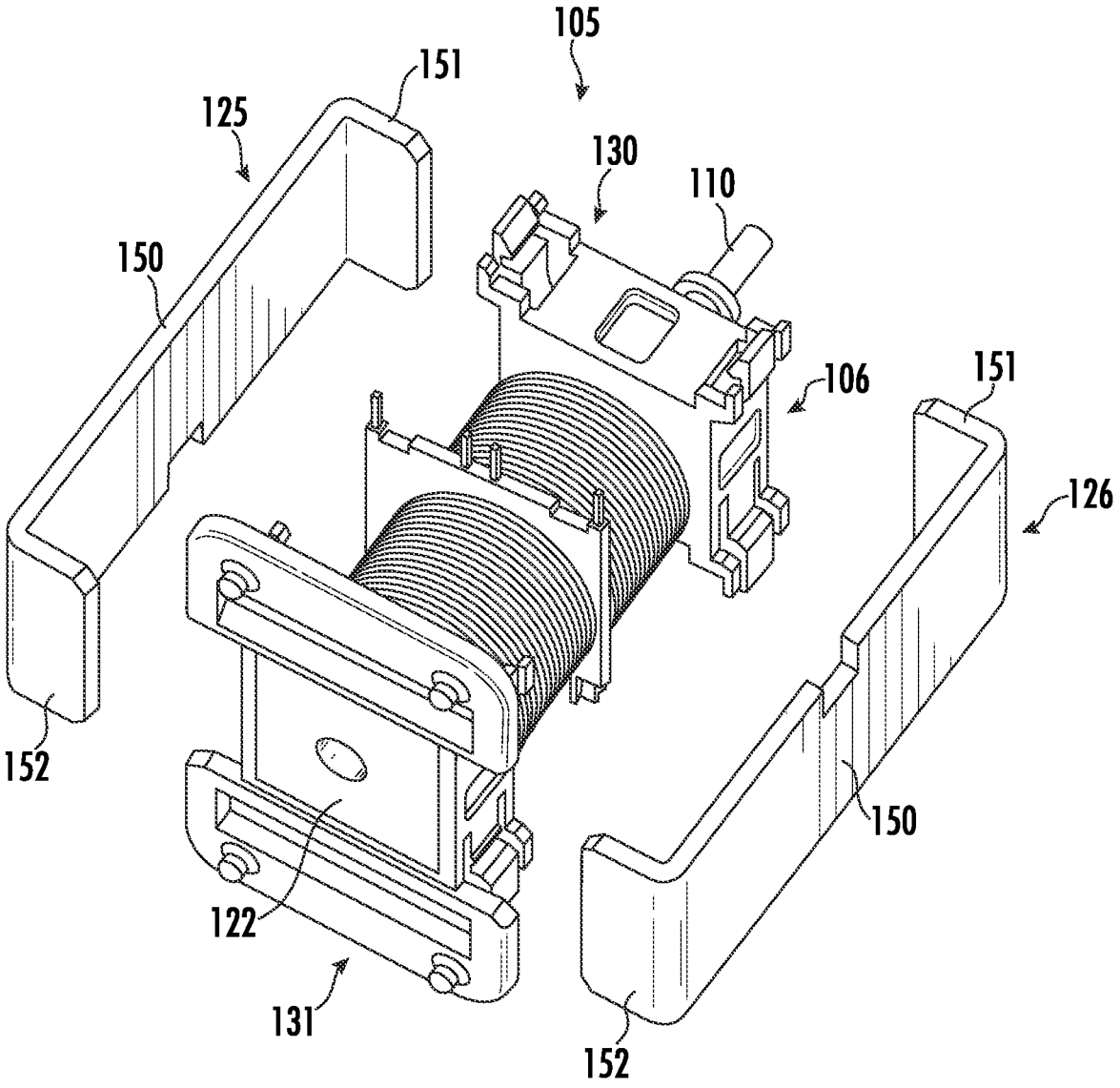
FIG. 3 is a partially exploded perspective view of a core of the assembly of FIG. 1 according to embodiments of the present disclosure.

FIG. 3 demonstrates the first and second shell components 125, 126 in a disconnected arrangement. As shown, the first and second shell components 125, 126 may each include a main body 150 extending between the first end section 130 and the second end section 131 of the support structure 106. The first and second shell components 125, 126 may further include a first end portion 151 and a second end portion 152 extending from the main body 150. The first and second end portions 151, 152 may extend perpendicular/transverse to the main body 150 for contact with the first and second magnets 121, 122. It will be appreciated that the first and second shell components 125, 126 may take on a variety of different shapes/configurations in other embodiments.

Figure 4:
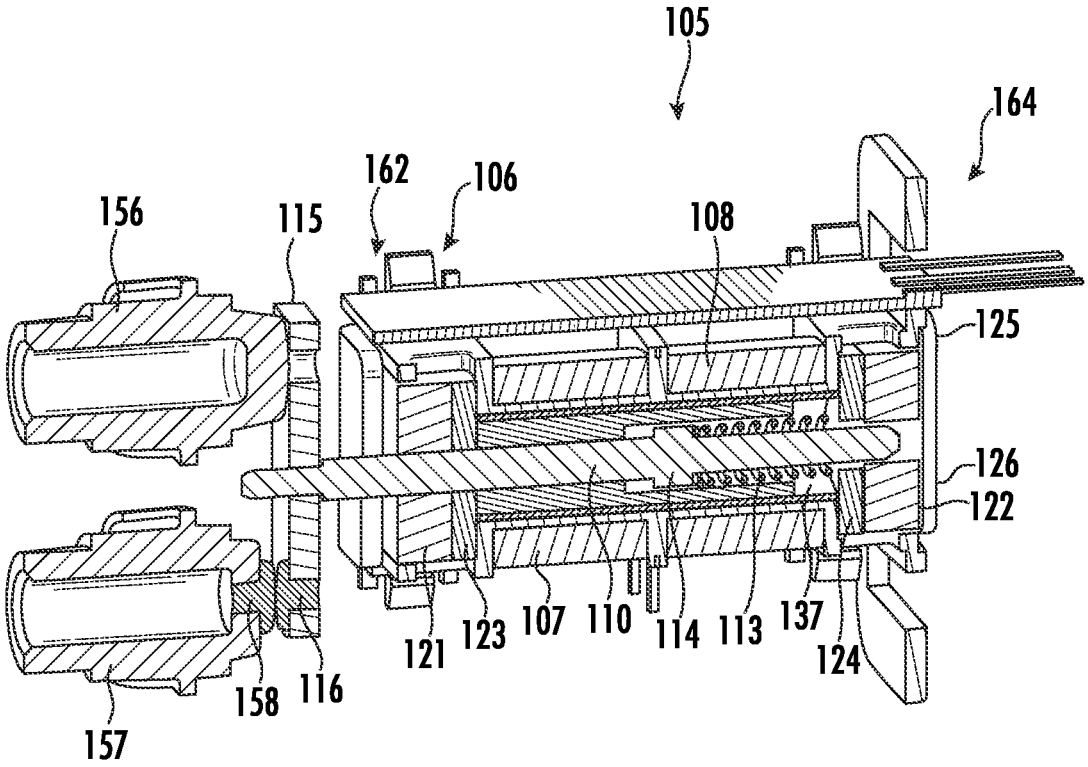
FIG. 4 depicts a perspective cross-sectional view of the core of the assembly of FIG. 1 according to embodiments of the present disclosure.
Figure 5:
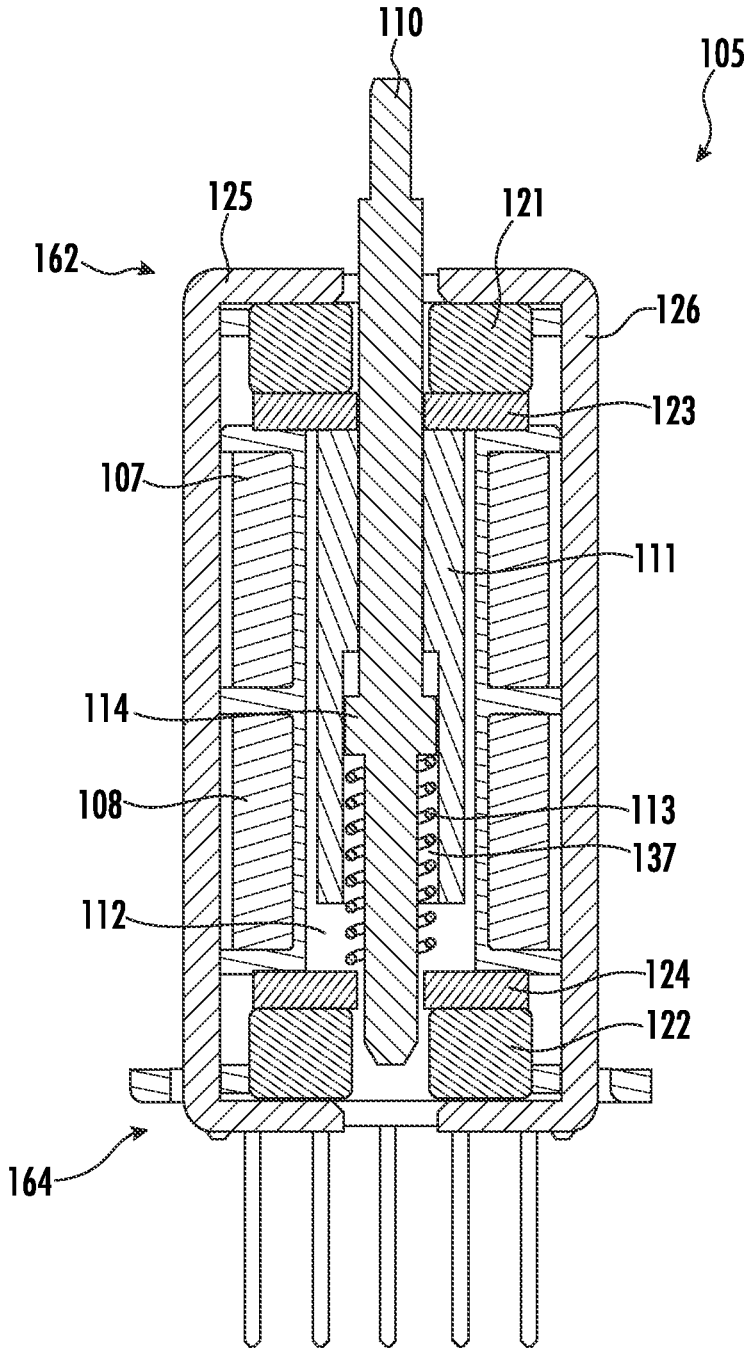
FIG. 5 depicts a side cross-sectional view of the core of the assembly of FIG. 1 according to embodiments of the present disclosure.

Turning now to FIGS. 4-5, the core assembly 105 will be described in greater detail. As shown, the plunger 110 may extend through the first magnet 121 and the first ferromagnetic plate 123 at a first end 162 of the support structure 106, and extend through the second magnet 122 and the second ferromagnetic plate 124 at a second end 164 of the support structure 106. The spring 113 may be positioned within an internal cavity 137 defined by the first core shaft 111 and the second core shaft 112. The spring 113 includes a first end in direct contact with the flange 114 of the plunger 110, and a second end in direct contact with the second ferromagnetic plate 124. The spring 113 is operable to bias the plunger 110 and the contact plate 115 towards corresponding contact components 156, 157 (FIG. 5). More specifically, the contact plate 115 and the plunger 110 are configured to make/break contact between contact 116 and contact 158. As shown, the first and second shell components 125, 126 are held in position by magnetic forces from the first and second magnets 121, 122.

During operation, when the first coil 107 is energized, the magnetic field moves the plunger 110 towards the contact components 156, 157, which may correspond to a closed position due to the positioning and connection of the contact(s) 116. When the second coil 108 is energized in the other direction, the magnetic field pulls the plunger 110 back towards the second end 164 of the support structure 106, where it is held (e.g., against the spring force) in place by the second magnet 122.

Although not shown, the assembly 100 may operate with a trigger circuit, which may include a condition detection module and may optionally include a power detection module. In some examples, the modules may be implemented using conventional analog, digital circuit, and/or programmable components. For example, the trigger circuit may be realized from a voltage detection circuit with a fixed width pulse generator. In some examples, a programmable integrated circuit (e.g., microprocessor, or the like) may be used to implement the modules. For example, a microprocessor may be programmed to monitor a first power rail for an interruption in power, and when an interruption in power is detected, the detection module may signal an actuator. This may be facilitated by using a microprocessor having a low voltage interrupt feature, wherein the low voltage interrupt is configured to detect a low voltage condition of the first power rail and send a signal (e.g., the interrupt) to the actuator via a signal line.

In some examples, the trigger circuit may include a comparator to detect the threshold voltage, which may then trigger a one-shot circuit to pulse the actuator for the correct amount of time. With some examples, an analog comparator on-board a microcontroller chip can be used to detect the threshold voltage while a timer can be used to control the pulse width. Some examples may include a brownout voltage detector operably connected to a comparator to generate an interrupt to a microcontroller.

Figure 6:
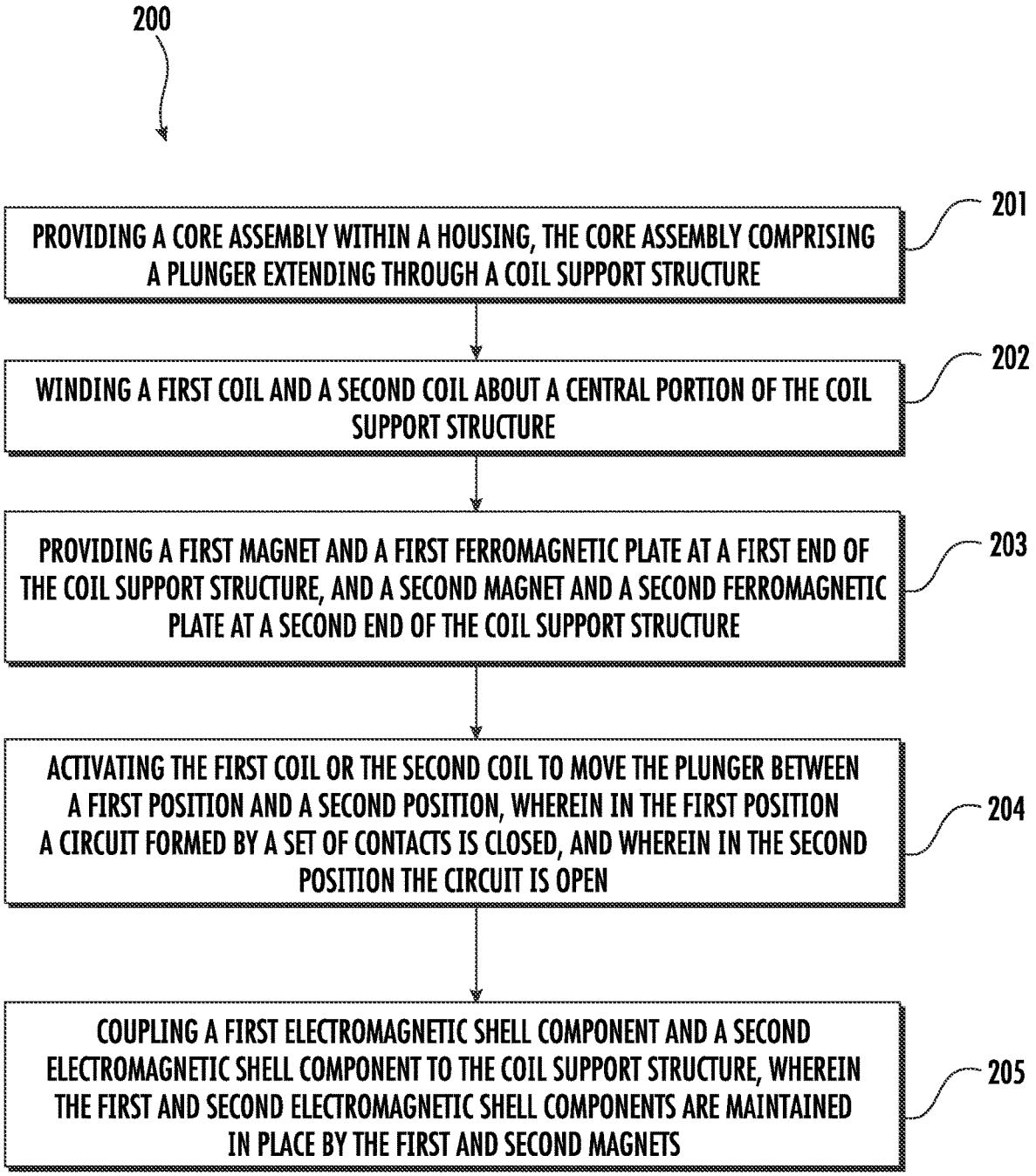
FIG. 6 is a flowchart depicting a method according to embodiments of the present disclosure.

Turning now to FIG. 6, a method 200 according to embodiments of the present disclosure is shown. At block 201, the method 200 may include providing a core assembly within a housing, the core assembly comprising a plunger extending through a coil support structure. In some embodiments, the plunger may be coupled to a contact plate. In some embodiments, the contact plate may include one or more contacts operable to make/break contact with a corresponding contact to close/open a circuit of the core assembly.

At block 202, the method 200 may include winding a first coil and a second coil about a central section of the coil support structure. In some embodiments, the first and second coils are separated by a separator plate extending substantially perpendicular/radially from a central section of the coil support structure.

At block 203, the method 200 may include providing a first magnet and a first ferromagnetic plate at a first end of the coil support structure, and a second magnet and a second ferromagnetic plate at a second end of the coil support structure. In some embodiments, the first and second magnets are in direct physical and electrical contact with the first and second ferromagnetic plates, respectively. In some embodiments, the first magnet and the first ferromagnetic plate are positioned within a first end section of the coil support structure, and the second magnet and the second ferromagnetic plate are positioned within a second end section of the coil support structure.

At block 204, the method 200 may include activating/energizing the first coil or the second coil to move the plunger between a first position and a second position, wherein in the first position a circuit formed by a set of contacts is closed, and wherein in the second position the circuit is open.

At optional block 205, the method 200 may include coupling a first electromagnetic shell component and a second electromagnetic shell component to the coil support structure, wherein the first and second electromagnetic shell components are maintained in place by the first and second magnets. In some embodiments, the method may include positioning the first electromagnetic shell component within a first end first recess of the first end section and within a second end first recess of the second end section, and positioning the second electromagnetic shell component within a first end second recess of the first end section and within a second end second recess of the second end section.

As used herein, a module might be implemented utilizing any form of hardware, software, or a combination thereof. For example, one or more processors, controllers, ASICs, PLAs, logical components, software routines or other mechanisms might be implemented to make up a module. In implementation, the various modules described herein might be implemented as discrete modules or the functions and features described can be shared in part or in total among one or more modules. In other words, as would be apparent to one of ordinary skill in the art after reading this description, the various features and functionality described herein may be implemented in any given application and can be implemented in one or more separate or shared modules in various combinations and permutations. Although various features or elements of functionality may be individually described or claimed as separate modules, one of ordinary skill in the art will understand these features and functionality can be shared among one or more common software and hardware elements.

For the sake of convenience and clarity, terms such as "top," "bottom," "upper," "lower," "vertical," "horizontal," "lateral," and "longitudinal" will be used herein to describe the relative placement and orientation of components and their constituent parts as appearing in the figures. The terminology will include the words specifically mentioned, derivatives thereof, and words of similar import.

As used herein, an element or operation recited in the singular and proceeded with the word "a" or "an" is to be understood as including plural elements or operations, until such exclusion is explicitly recited. Furthermore, references to "one embodiment" of the present disclosure are not intended as limiting. Additional embodiments may also incorporating the recited features.

Furthermore, the terms "substantial" or "substantially," as well as the terms "approximate" or "approximately," can be used interchangeably in some embodiments, and can be described using any relative measures acceptable by one of ordinary skill in the art. For example, these terms can serve as a comparison to a reference parameter, to indicate a deviation capable of providing the intended function. Although non-limiting, the deviation from the reference parameter can be, for example, in an amount of less than 1%, less than 3%, less than 5%, less than 10%, less than 15%, less than 20%, and so on.

While certain embodiments of the disclosure have been described herein, the disclosure is not limited thereto, as the disclosure is as broad in scope as the art will allow and the specification may be read likewise. Therefore, the above description is not to be construed as limiting. Instead, the above description is merely as exemplifications of particular embodiments. Those skilled in the art will envision other modifications within the scope and spirit of the claims appended hereto.

What is claimed is:

1. A method, comprising:

providing a core assembly within a housing, the core assembly comprising a plunger extending through a coil support structure;

winding a first coil and a second coil about a central section of the coil support structure;

providing a first magnet at a first end of the coil support structure;

providing a second magnet at a second end of the coil support structure; and coupling a first electromagnetic shell component and a second electromagnetic shell component to the coil support structure, wherein the first and second electromagnetic shell components enclose the first and second coils, and wherein the first and second electromagnetic shell components are maintained in position by the first and second magnets.

2. The method of claim 1, further comprising directly connecting the first and second electromagnetic shell components to the first and second magnets.

3. The method of claim 1, further comprising activating the first coil to move the plunger towards the first end of the coil support structure.

4. The method of claim 3, further comprising:

coupling the plunger to a contact plate including a contact; and maintaining a first position of the contact plate and the contact in response to activation of the first coil.

5. The method of claim 4, further comprising making electrical contact between the contact and a corresponding contact when the contact plate and the contact are in the first position.

6. The method of claim 4, further comprising activating the second coil to move the plunger towards the second end of the coil support structure.

7. The method of claim 6, further comprising maintaining a second position of the contact plate and the contact in response to activation of the second coil.

8. The method of claim 1, further comprising positioning a spring within a first core shaft of the core assembly, the spring in contact with a flange of the plunger to bias the plunger towards the first end of the coil support structure.

9. The method of claim 1, further comprising:

positioning the first magnet within a first end section of the coil support structure; and positioning the second magnet within a second end section of the coil support structure.

10. The method of claim 9, further comprising:

positioning the first electromagnetic shell component within a first end first recess of the first end section and within a second end first recess of the second end section; and positioning the second electromagnetic shell component within a first end second recess of the first end section and within a second end second recess of the second end section.

11. The method of claim 1, further comprising:

providing a first end portion of the first and second electromagnetic shell components in direct contact with the first magnet; and providing a second end portion of the first and second electromagnetic shell components in direct contact with the second magnet.

12. The method of claim 1, further comprising:

providing a first ferromagnetic plate in contact with the first magnet; and providing a second ferromagnetic plate in contact with the second magnet.

13. The method of claim 12, further comprising:

positioning the first ferromagnetic plate between the first magnet and the first coil; and positioning the second ferromagnetic plate between the second magnet and the second coil.

14. A method, comprising:

providing a core assembly including a plunger extending through a coil support structure;

winding a first coil and a second coil about a central section of the coil support structure;

providing a first magnet and a first ferromagnetic plate at a first end of the coil support structure;

providing a second magnet and a second ferromagnetic plate at a second end of the coil support structure;

coupling a first electromagnetic shell component and a second electromagnetic shell component to the coil support structure, wherein the first and second electromagnetic shell components enclose the first and second coils, and wherein the first and second electromagnetic shell components are maintained in place by the first and second magnets; and activating the first coil or the second coil to move the plunger between a first position and a second position, wherein in the first position a circuit formed by a set of contacts is closed, and wherein in the second position the circuit is open.

15. The method of claim 14, further comprising:

providing a first end portion of the first and second electromagnetic shell components in direct contact with the first magnet; and providing a second end portion of the first and second electromagnetic shell components in direct contact with the second magnet.

16. The method of claim 14, further comprising:

positioning the first electromagnetic shell component within a first end first recess of the first end portion and within a second end first recess of the second end portion; and positioning the second electromagnetic shell component within a first end second recess of the first end portion and within a second end second recess of the second end portion.

17. The method of claim 14, further comprising positioning a spring within a first core shaft of the core assembly, the spring in contact with a flange of the plunger to bias the plunger towards the first end of the coil support structure.

18. The method of claim 14, further comprising:

positioning the first magnet and the first ferromagnetic plate within a first end section of the coil support structure; and positioning the second magnet and the second ferromagnetic plate within a second end section of the coil support structure.

19. The method of claim 14, further comprising:

positioning the first ferromagnetic plate between the first magnet and the first coil; and positioning the second ferromagnetic plate between the second magnet and the second coil.

* * * * *